US005316052A

United States Patent [19]

Ritter et al.

[11] Patent Number: 5,316,052

[45] Date of Patent: May 31, 1994

[54] MACHINE FOR MAKING WIRE LATTICE MATS OF WELDED LONGITUDINAL AND CROSS WIRES WITH WELDED END LOOPS

[75] Inventors: Klaus Ritter; Gerhard Ritter; Anton Lassbacher, all of Graz, Austria

[73] Assignee: EVG Entwicklungs- u. Verwertungs-gesellschaft m.b.H., Raaba, Austria

[21] Appl. No.: 989,007

[22] PCT Filed: Jul. 16, 1992

[86] PCT No.: PCT/AT92/00099

§ 371 Date: Mar. 1, 1993

§ 102(e) Date: Mar. 1, 1993

[87] PCT Pub. No.: WO93/01904

PCT Pub. Date: Feb. 4, 1993

[30] Foreign Application Priority Data

Jul. 17, 1991 [AT] Austria ..... 1438/91

[51] Int. Cl.[5] ..... B21F 27/14

[52] U.S. Cl. ..... 140/112; 72/388

[58] Field of Search ..... 72/388; 140/74, 93 C, 140/107, 24

[56] References Cited

U.S. PATENT DOCUMENTS 3,253,621 5/1966 Hogan et al. ..... 140/74
4,526,025 7/1985 Ritter et al. ..... 72/388
4,681,210 7/1987 Miki et al. .

FOREIGN PATENT DOCUMENTS 377713 4/1985 Austria .
0101675 2/1984 European Pat. Off. .
0379043 7/1990 European Pat. Off. .
2407349 8/1974 Fed. Rep. of Germany .
2514187 5/1976 Fed. Rep. of Germany .
3442357 5/1986 Fed. Rep. of Germany .

*Primary Examiner*—Lowell A. Larson
*Attorney, Agent, or Firm*—Frishauf, Holtz, Goodman & Woodward

[57] ABSTRACT

A machine for processing wire lattice mats made of welded-together longitudinal and cross wires, with a device for bending back cross wire end pieces extending beyond the longitudinal edge wires of the lattice mat to form loops, the bending device (U) having a bending template (14) which is displaceable in the a guide block (11) and a bending tool (10) eccentrically disposed on a bending plate (8) and pivotable around the bending template, the guide block located opposite the bending plate constituting a support surface (12) for the wire to be bent, and where the bending tool can be moved back and forth between a work position for a wire to be bent and a rest position, in which a penetration gap for a wire to be bent is formed between the support surface of the guide block and the bending tool.

13 Claims, 2 Drawing Sheets

MACHINE FOR MAKING WIRE LATTICE MATS OF WELDED LONGITUDINAL AND CROSS WIRES WITH WELDED END LOOPS

FIELD OF THE INVENTION

The invention relates to a machine for making wire lattice mats made of welded longitudinal wires and cross wires and having a device for bending back of end pieces of cross wires extending beyond the longitudinal edge wires of the lattice mat to form end loops.

BACKGROUND

It is known to use a bending device having an approximately circular-cylindrical bending template which is displaceable in the direction of its axis in a guide block, and a bending tool eccentrically disposed on a bending plate and pivotable around the bending template, the guide block located opposite the bending plate constituting a support surface for the wire to be bent, and where a device for welding the cross wire end pieces which are bent back to the longitudinal edge wires and, if desired, a device for beveling the loops are preferably disposed downstream of the bending device.

A bending device is known from U.S. Pat. No. 4,526,025, to which Austrian Patent AT-PS 377 713 corresponds, wherein the approximately circular-cylindrical bending template is axially displaceable between a working position, in which the front faces of the bending template and the bending plate touch, and a rest position, in which these two front faces delimit between each other a penetrating gap for the cross wire end piece to be bent. The front face of the bending template and the support surface of the guide block are located opposite the front face of the bending plate and during bending enclose the cross wire end piece to be bent, so that during bending the cross wire end piece can be supported on the one hand on the support surface of the guide block and on the other on the front face of the bending plate, by means of which shifting of the cross wire end piece out of the plane of the cross wires is prevented. In this bending device it is disadvantageous that, although in its initial position the bending tool can keep the feed path for the cross wire end piece bent into a loop free, an unbent, straight cross wire end piece cannot pass the bending device. It is furthermore possible to bend the cross wire end pieces of a wire lattice mat into loops in only one direction with the aid of this bending device.

A bending device for bending of hoops from rod-shaped material is known from German Patent Publication DE-C2 25 14 187. This bending device has a support frame which can be moved back and forth perpendicularly to the direction of the material feed, on which are disposed a rotatable bending plate provided with an eccentric bending block and a guide peg for the material to be bent, which can be moved back and forth in relation to the bending plate and is disposed almost in the center axis of the bending plate, but is not rotatable. Both the guide peg and the bending plate are located on the same side of the material to be bent. This bending device has the disadvantage that a support surface for the wire to bent is lacking on the side of the support surface located opposite the bending plate, so that during bending of cross wire end pieces of wire lattice mats into loops it is not possible to prevent the bent cross wire end sections from shifting out of the plane of the cross wires.

THE INVENTION

It is the object to produce a machine of the previously recited type in which the bending template and the bending tool keep the feed path of the cross wire end pieces of a wire lattice mat completely free and where simultaneously the employment of a plurality of bending devices for bending a plurality of cross wire end pieces successively in a production line is to be possible for adaptation to the high process speed of modern welding machines for structural steel lattices. In addition, it is to be made possible to bend the cross wire end pieces of a wire lattice mat in the feed direction of the lattice as well as in the opposite direction. It should be assured in all cases that the cross wire end piece cannot shift out of the plane of the cross wires in the course of the bending process.

Briefly, the machine in accordance with the invention has the characteristics that the bending tool of the bending device can be moved back and forth between a work position for bending the wire and a rest position. A penetration gap for a wire to be bent is formed between the support surface of the guide block and the bending tool.

In accordance with a preferred form of embodiment of the invention, the bending head has a bending plate which is fixedly connected with the bending shaft which can be rotated and supports the bending tool, the bending head being pivotably seated in a frame by means of a pivot lever.

For increasing the production output, it is possible for simultaneous bending of a plurality of cross wire end pieces to dispose at least two bending device units with pivotable bending heads, guide blocks and axially displaceable bending templates one behind the other in the direction of the longitudinal wires at a selectable distance, and it is preferably possible to connect respectively a welding device and, if desired, a beveling device downstream of these device units.

For alternating bending of the cross wire end pieces of wire lattice mat, at least two bending device units with pivotable bending heads, guide blocks and axially displaceable bending templates are alternatively provided, which are displaceable along a slide rail during the bending operation, and a welding device and, if desired, a beveling device is preferably placed downstream of these device units.

DRAWINGS

The invention will be described in greater detail below by means of an exemplary embodiment, making reference to the drawings.

DETAILED DESCRIPTION

The wire lattice mat to be processed comprises a plurality of longitudinal wires L arranged parallel to each other, at least one longitudinal edge wire R (FIGS. 3–5) per wire lattice mat edge, cross wires Q disposed perpendicularly to all longitudinal wires L, R and welded to them, and cross wire end pieces E, which each extend beyond the longitudinal edge wire R. With the aid of a bending device U, the cross wire end pieces E are bent back towards the respective longitudinal edge wire R in such a way that loops S are created, and the finished bent cross wire end pieces are suitably welded near their free end to the respective longitudinal edge wire R in a process step following the bending process with the aid of a welding device V placed downstream of the bending device. Subsequently the loops S are beveled in the direction toward the plane of the longitudinal wires with the aid of a beveling device W in a further process step. When depositing an unturned wire lattice mat and a wire lattice mat turned over 180° around its longitudinal axis in a stack, space-saving meshing of the pluralities of longitudinal and cross wires of adjoining wire lattice mats is made possible by the beveled loops.

The machine of the invention with the bending device U, the welding device V and the beveling device W is suitably placed downstream of the welding machine for producing the lattice mat, in the course of which the lattice is pushed forward by the feed devices of the lattice welding machine in the direction $P_1$ (FIG. 1) during the work cycle.

Figure 2:
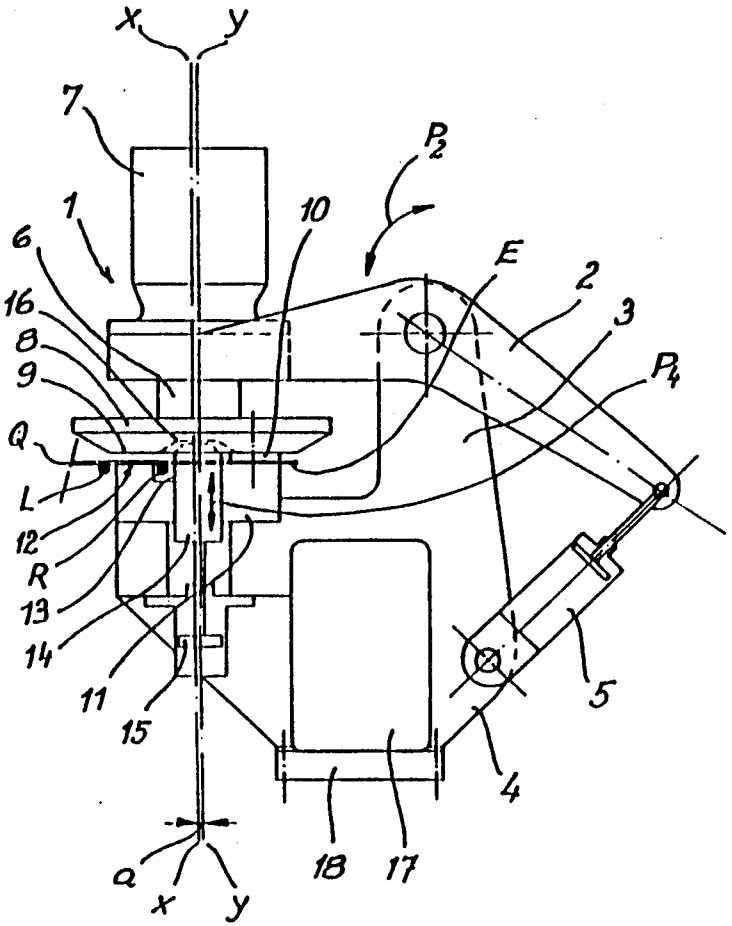
FIG. 2 shows a view of the same machine seen in the direction of the longitudinal wires.
Figure 1:
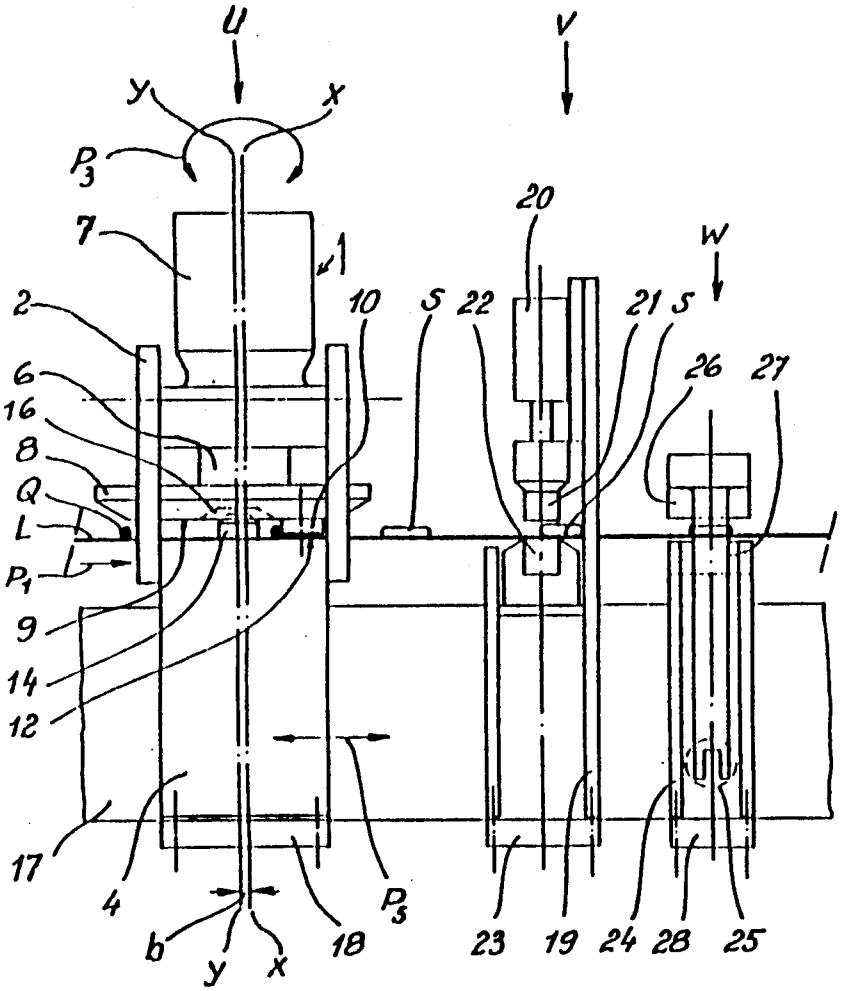
FIG. 1 shows a view of a processing machine of the invention seen in the direction of the cross wires.

The bending device U illustrated in FIGS. 1 and 2 has a bending head 1 fastened on a pivot lever 2. The pivot lever 2 is seated, pivotable in accordance with the two-headed arrow $P_2$, on a support arm 3 of a frame 4, and the pivot movement of the lever 2 effected by a work cylinder 5 supported on the frame 4.

The bending head 1 has a bending shaft 6, which is rotatable around its axis X—X in accordance with the two-headed arrow $P_3$ with the aid of a drive motor 7. A bending plate 8 is fastened on the bending shaft 6, the surface 9 of which, facing the lattice, is formed as the support surface for the cross wire end piece to be bent. The bending plate 8 supports an eccentrically disposed bending tool 10. The bending tool 10 is pivoted out of a work position for bending the cross wire end piece E into a rest position which unblocks the feed path of the cross wire end pieces E and vice versa by the pivotal movement of the bending head 1 in accordance with the two-headed arrow $P_2$.

In the illustrated example, the bending tool 10 has a roller rotatably seated on the bending plate 8, by means of which damage of the wire surface by the bending tool during the bending process because of a possible relative movement between the bending tool and the wire is prevented.

Figures 3, 4, 5:
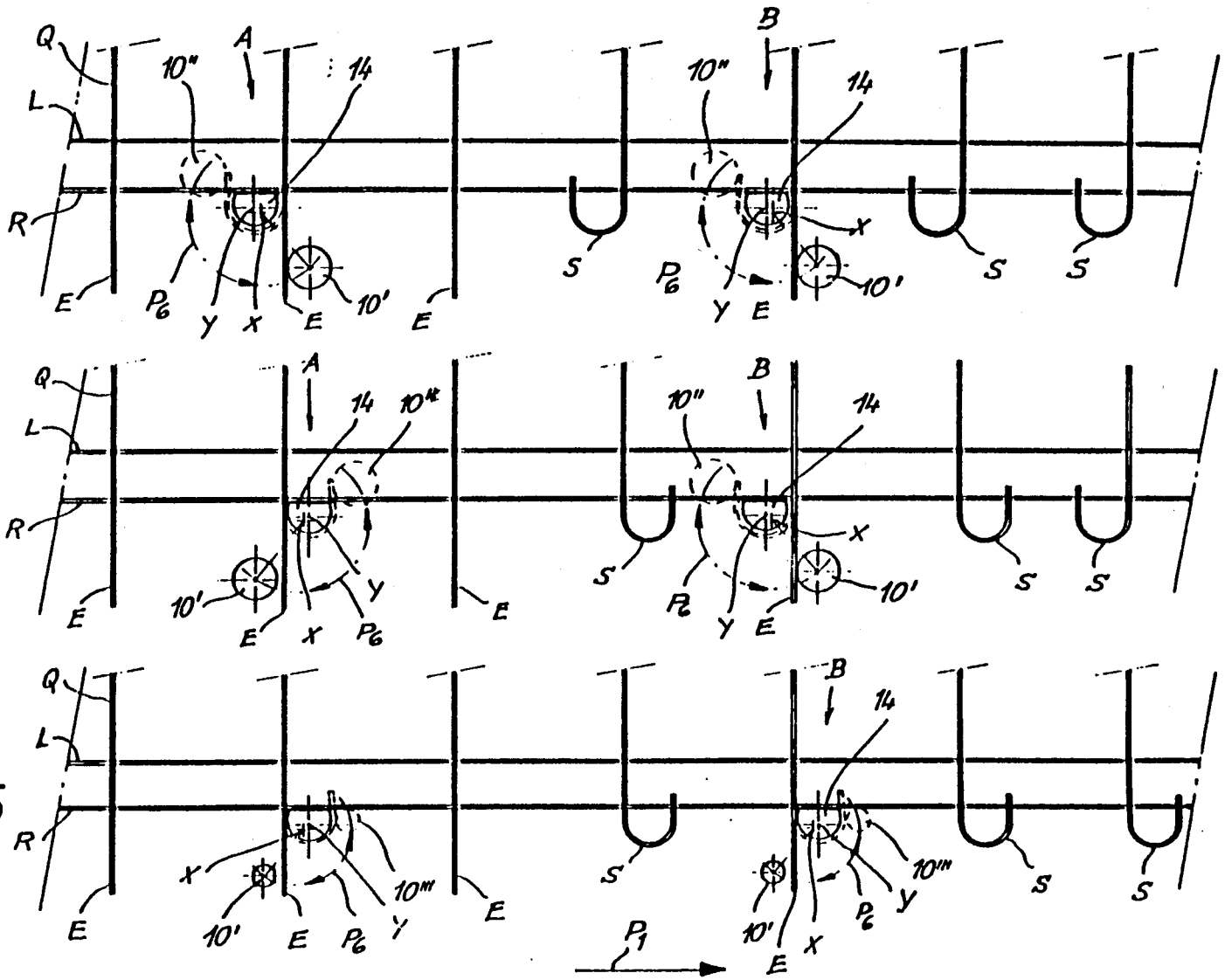
FIGS. 3 to 5 show examples of use with respectively two bending devices for the simultaneous bending of cross wire end pieces of wire lattice mats.

A guide block 11 disposed on the frame 4 is located opposite the bending plate 8, the surface 12 of which facing the lattice is formed as a slide surface for the cross wires Q and as support surface for the cross wire end piece E to be bent. A guide groove 13 for receiving the longitudinal edge wire R has been additionally cut into this surface 12. A bending template 14, the front face of which faces the support surface 9 of the bending plate 8, is seated in the guide block 11 and is displaceable with the aid of a driven piston 15 in accordance with the two-headed arrow $P_4$ in the axial direction between a rest position and a work position. The bending template 14 is interchangeable and in the illustrated example has, as shown in FIGS. 3 to 5, the shape of a peg with a cross section in the form of a segment of a circle, the radius of the segment of the circle being adapted to the radius of the loop S to be bent. The chord of the segment of the circle faces the longitudinal edge wire R.

The central axis Y—Y of the bending template 14 is offset in respect to the rotational axis X—X of the bending plate 8 in the direction of the cross wire by an eccentric value a (FIG. 2) and in the direction of the longitudinal wire by an eccentric value b (FIG. 1). The values a and b depend on the diameter of the wire to be bent and on the loop radius and are selected in such a way that a relative movement between the bending tool 10 and the cross wire end piece E in the course of the bending process is prevented, if possible. In its rest position the bending template 14 is completely retracted into the guide block 11, so that following the bending process the loop S is unblocked and can pass unhampered between the support surface 9 of the bending plate 8 and the front face of the bending template during feeding of the lattice. In its work position, the bending template 14 extends out of the guide block 11 sufficiently far so that the front face of the bending template 14 and the support face 9 of the bending plate 8 at least touch. To reliably prevent shifting of the cross wire end piece E, the bending template 14 suitably extends into a correspondingly shaped recess 16 of the bending plate 8 when in working position.

The bending device is displaceable parallel to the lattice feed direction $P_1$ via drive means, not shown, on a slide rail 17 in accordance with the two-headed arrow $P_5$ for adaptation to different cross wire divisions of the lattice and can be arrested in the appropriate bending position by means of the clamping plate 18.

The welding device V shown in FIG. 1 and placed downstream of the bending device U in the direction of the lattice feed $P_1$ has a receptacle 19 supporting an upper electrode 21, which can be lifted and lowered by means of a welding cylinder 20, and a lower electrode 22. The receptacle 19 is displaceably disposed on the slide rail 17 and can be arrested in the appropriate welding position by means of a clamping plate 23.

The beveling device W, in the illustrated example placed downstream of the welding device V, has a support frame 24 which supports bevelling tool 26, which can be lifted and lowered by means of a work cylinder 25, and a brace 27. The support frame 24 is also displaceably disposed on the slide rail 17 and can be arrested in the appropriate beveling position by means of a clamping plate 28.

The application of two bending devices of the invention for preferably simultaneous bending of respectively two cross wire end pieces E in a direction against the lattice feed direction $P_1$ is schematically shown in FIG. 3. In this case, one bending device each is in the position A and B, respectively, the mutual distance between which can be freely selected, which corresponds to four times the cross wire end division in the exemplary embodiment shown. The initial position of the bending tools immediately prior to the bending process is shown by 10' and in solid lines, and the end position of the bending tools immediately following the completed bending process is shown by 10'' in dashed form. The bending movement of the bending tools corresponds to the two-headed arrow $P_6$.

To allow the unhampered feeding of a straight cross wire end piece E as far as the bending device in the position B, it is necessary that with the bending device in position A the bending template 14 be retracted into its position of rest inside the guide block and the bending head be pivoted out sufficiently far so that the bending tool 10' unblocks the feed path of the cross wire end piece. After the straight cross wire end piece E has passed the bending device which is in position A, the bending head of this bending device is pivoted back into the work position. The bending tools of the bending devices extending into the feed path of the cross wire end piece E in positions A and B are used as stops for the cross wire end pieces moving in the direction $P_1$ and determine their position prior to the bending process. The bending template 14 is extended into its work position for bending the cross section end pieces E and subsequently the bending tool is pivoted from the initial position 10' into the end position 10'' with the aid of the drive motor, and in this way the cross wire end piece E is bent around the bending template 14. It is necessary to retract the bending template 14 into its rest position after every bending operation to release the just bent loop S and allow a renewed feed movement of the lattice.

Use of a processing machine of the invention with two bending devices in bending positions A and B for bending the cross section end pieces in the direction of as well as counter to the direction of the lattice feed direction $P_1$ is shown in FIG. 4. The bending device in position A bends the cross wire end pieces in the feed direction of the lattice, the bending device in position B bends the cross wire end pieces counter to the lattice feed direction, as in FIG. 3. To be able to feed a cross wire end piece E to the bending device in position A, the bending head must be pivoted away. The bending template 14 is in its work position, in this way forms a stop for the forward-moving cross wire end piece and fixes it in the position prior to the bending process. To be able to feed a cross wire end piece E to the bending device in position B, it is necessary in the bending device in position A to pivot the bending head out of the work position and, in addition, the bending templates of the bending device in position A as well as the bending device in position B must be retracted into their respective rest positions within the guide block. The bending tool 10' of the bending device in position B is in its work position and forms a stop for the forward moving cross wire end piece.

During the bending movements in accordance with FIGS. 3 and 4, the bending tools are moved along the longitudinal edge wire R of the lattice in the course of the bending process.

An example of use is shown in FIG. 5, where the cross wires are located underneath the longitudinal wires and for this reason the bending tools can move only as far as the position immediately ahead of the longitudinal edge wire R during the bending process. To be able in this case to bring the bending tool as close as possible to the longitudinal end wire R, the diameter of the bending tool must be selected to be as small as possible. As small as possible a diameter of the bending tool is also required in the examples of use in accordance with FIGS. 3 and 4, so as to be able to reach the respective end position 10'' during the bending process in a lattice with narrow cross wire divisions.

Control of the movements of the loop bending device U, the loop welding device V and the loop beveling device W is exerted by means of known control elements, which are suitably triggered directly by the control device of the lattice welding machine in order to be able to coordinate the bending device totally with the work cycle of the lattice welding machine.

It is understood that the invention is not limited to the exemplary embodiments shown, but that these can be changed in different ways within the scope of the concept of the invention. In particular, in place of the pivot movement of the bending head it is possible to perform a corresponding parallel displacement of it. It is furthermore possible within the scope of the invention to keep the bending head with the bending shaft and the bending plate stationary and only to displace the bending tool relative to the bending plate and perpendicularly to the plane of the plurality of longitudinal wires by means of suitable drive means to unblock the feed path of the cross wire end pieces.

For the simultaneous bending of several cross wire end pieces it is possible to dispose a plurality of bending devices with the loop welding device(s) and loop beveling device(s) associated with each bending device or all bending devices successively in the production line, where all bending heads, as shown in FIGS. 1 and 2, can be located above the wire lattice mat or also, turned by 180°, below the wire lattice mat.

With dual step lattice welding machines which weld two cross wires simultaneously to the longitudinal wires in one work cycle, respectively two loop bending devices, loop welding devices and loop beveling devices per wire lattice mat edge are disposed behind each other and are each simultaneously triggered.

With modern, rapidly operating single step lattice welding machines, which in one work cycle only weld one cross wire to the longitudinal wires and the work cycle of which is shorter than the time required for bending the loop, two loop bending devices per wire lattice mat edge are also disposed behind each other and are operated in the following manner: while the lattice welding machine stops for welding a cross wire, one loop bending device is in its bending position, in this position accepts the cross wire end piece to be bent and starts the bending process. In the course of the subsequent lattice feed, the loop bending device moves on the slide rail 17 along with the lattice under the effect of controlled drive means, not shown, and completes the bending process. During the next stop of the lattice welding machine for welding another cross wire, the loop bending device releases the finished loop and then moves back into the bending position under the effect of the drive means to accept there another cross wire piece to be bent. During the forward movement of the first loop bending device, the second loop bending device moves into its bending position. Take-over of a cross wire end piece to be bent by the second loop bending machine preferably takes place simultaneously with the release of the finished bent loop by the first loop bending machine when the welding machine stops. In this example of use it is possible to provide either a common loop welding device and a common loop beveling device for the two loop bending devices or a separate loop welding device and a separate loop beveling device for each loop bending device.

It is possible with the aid of the machine of the invention to bend all cross wire end pieces of a wire lattice mat into loops either against the lattice feed direction $P_1$ (FIG. 3) or in the lattice feed direction $P_1$ (FIG. 5). Within the scope of the invention it is furthermore possible to bend the cross wire end pieces of a wire lattice mat into loops either individually in alternation (FIG. 4) as well as in groups in alternation against the direction and in the direction of the lattice feed.

We claim:

1. A machine for making wire lattice mats made of welded longitudinal wires (L, R) and cross wires (Q), having a device (U) for bending back end pieces (E) of the cross wires which extend beyond a longitudinal edge wire (R) of the lattice mat to form end loops (S), said bending device having an approximately circular-cylindrical bending template (14) which is displaceable in the direction of its axis;

a bending plate (8);

a guide block (11) and a bending tool (10) eccentrically located on the bending plate (8) and pivotable about the bending template (14), the guide block (11) being located opposite the bending plate (8) and forming a support surface (12) for the wire to be bent; and a welding device (V) for welding the end loops (S) formed of the bent-back cross wire end pieces (E) to the longitudinal edge wires (L, R), located downstream of said bending device (U), wherein, in accordance with the invention, the bending tool (10) is movable back and forth between a work position for bending the wire and a rest position independently of the bending template (14), and, when in rest position, located to form a penetration gap for the end piece (E) of the cross wire to be bent, said penetration gap being formed between said support surface (12) of the guide block (11) and the bending tool (10).

2. The machine of claim 1, further comprising a bending shaft (6) rotatably supporting the bending tool, a bending head (1) forming part of said bending device (U), said bending head including said bending plate (8);

said bending plate (8) being fixedly connected with said bending shaft (6); and a pivot lever (2) pivotably securing the bending head (1) on 3. The machine of claim 2, wherein at least two bending devices (U) are provided, each having a bending head (1), a guide block (11) and an axially displaceable bending template, said at least two bending units being positioned in the machine, one behind the other in the direction of the longitudinal wires (L, R) at a selectable spacing;

and at least two welding devices (V) being provided, each being located downstream of a respective bending device (U).

4. The machine of claim 3, further including a slide rail (17) displaceably positioning said at least two bending devices (U) for selective positioning of said bending devices with respect to said cross wires (Q) to permit bending of said cross wires into said end loops (S), and wherein said end loops, selectively, extend in opposite direction or in the same direction from a center line of said end pieces (E) of the respective cross wires (Q).

5. The machine of claim 4, wherein the respective welding devices (V) are slidable and displaceable along said slide rail (17).

6. The machine of claim 2, further including a device (W) for beveling the terminal ends of said loops, positioned downstream of the welding device (V).

7. The machine of claim 1, wherein at least two bending devices (U) are provided, each having a bending head (1), a guide block (11) and an axially displaceable bending template (14), said at least two bending units being positioned in the machine, one behind the other in the direction of the longitudinal wires (L, R) at a selectable spacing;

said at least two welding devices (V) being provided, each being located downstream of a respective bending device (U).

8. The machine of claim 7, further including at least two devices (W) for beveling the terminal ends of said loops, positioned downstream of the welding devices (V), each associated with a respective bending device (U).

9. The machine of claim 7, further including a slide rail (17) displaceably positioning said at least two bending devices (U) for selective positioning of said bending devices with respect to said cross wires (Q) to permit bending of said cross wires into said end loops (S), and wherein said end loops, selectively, extend in opposite direction or in the same direction from a center line of said end pieces (E) of the respective cross wires (Q).

10. The machine of claim 9, further including at least two devices (W) for beveling the terminal ends of said loops, positioned downstream of the welding devices (V), each associated with a respective bending device (U).

11. The machine of claim 9, wherein the respective welding devices (V) are slidable and displaceable along said slide rail (17).

12. The machine of claim 11, further including at least two devices (W) for beveling the terminal ends of said loops, positioned downstream of the welding devices (V), each associated with a respective bending device (U).

13. The machine of claim 1, further including a device (W) for beveling the terminal ends of said loops, positioned downstream of the welding device (V).

* * * * *